US005143094A

United States Patent [19]

Nash et al.

[11] Patent Number: 5,143,094

[45] Date of Patent: Sep. 1, 1992

[54] CIGARETTE MACHINE TRIMMING DEVICE

[75] Inventors: Victor W. Nash, Richmond, Va.; Francis R. Oakley, Kernersville, N.C.

[73] Assignee: Molins PLC, United Kingdom

[21] Appl. No.: 710,331

[22] Filed: Jun. 5, 1991

[30] Foreign Application Priority Data

Jun. 5, 1990 [GB] United Kingdom ..... 9012541

[51] Int. Cl.[5] ..... A24C 5/18

[52] U.S. Cl. ..... 131/84.4; 131/84.1

[58] Field of Search ..... 131/84.1-84.4, 131/83.1

[56] References Cited

U.S. PATENT DOCUMENTS 4,567,902 2/1986 Gibbs et al. ..... 131/84.4

4,589,426 5/1986 Mattei ..... 131/84.4 X

*Primary Examiner*—Vincent Millin

*Assistant Examiner*—J. Doyle

*Attorney, Agent, or Firm*—Antonelli, Terry, Stout & Kraus

[57] ABSTRACT

A trimming device for trimming a cigarette filler stream in a cigarette making machine comprises two cooperating disc assemblies (2,3) arranged to rotate at equal speeds about laterally spaced axes (4,5) and including discs (11,12) from the respective assemblies which overlap to trim the filler stream at a first trim level and are formed with cut-outs (15) in their peripheries which register during rotation of the disc assemblies so as to allow additional quantities of tobacco to project through them to form cigarette dense end portions of the filler stream, the two disc assemblies including additional discs (16,17) arranged to cooperate so as to trim away, at a set level in relation to the first trim level, excess quantities of tobacco projecting through the cut-outs (15).

9 Claims, 1 Drawing Sheet

CIGARETTE MACHINE TRIMMING DEVICE

Cigarette making machines commonly include a trimming device for removing excess tobacco from a cigarette filler stream carried by an airpervious conveyor by means of suction. A common form of trimming device comprises two discs set in a common plane and having their peripheries in close proximity so as to separate retained tobacco (above the discs) from tobacco which is removed with the aid of a rotary brush. In many instances the discs, which rotate so that their peripheral velocities equal that of the cigarette filler stream, have recesses at regular intervals for leaving additional quantities of tobacco at positions corresponding to the cigarette ends: in other words, for "dense ending" purposes.

An example of a trimming device of the type described above is shown in U.S. Pat. No. 3,089,497.

The present invention is concerned with an improved form of trimming device employing overlapping discs. The use of overlapping discs is known per se. for example from U.S. Pat. No. 4,567,902, the present invention being an improvement particularly in regard to its dense ending arrangement.

According to the present invention, a trimming device comprises two cooperating disc assemblies arranged to rotate at equal speeds about laterally spaced axes and including discs from the respective assemblies which overlap to trim the filter stream at a first trim level and are formed with cut-outs in their peripheries which register during rotation of the disc assemblies so as to allow additional quantities of tobacco to project through them, to form cigarette dense end portions of the filter stream, the two disc assemblies including additional discs arranged to cooperate so as to trim away, at a set level in relation to the first trim level, excess quantities of tobacco projecting through the cut-outs.

The overlapping discs are preferably of significant thickness so as to have adequate rigidity, and are chamfered at their peripheries to produce sharp edges. In a preferred arrangement the two disc assemblies are of substantially identical thickness, the gaps which would otherwise be left on account of the overlapping of the first-mentioned discs being filled by additional discs as shown in the drawings and as described below.

An example of a trimming device according to this invention is shown in the accompanying drawings. In these drawings.

Figure 1:
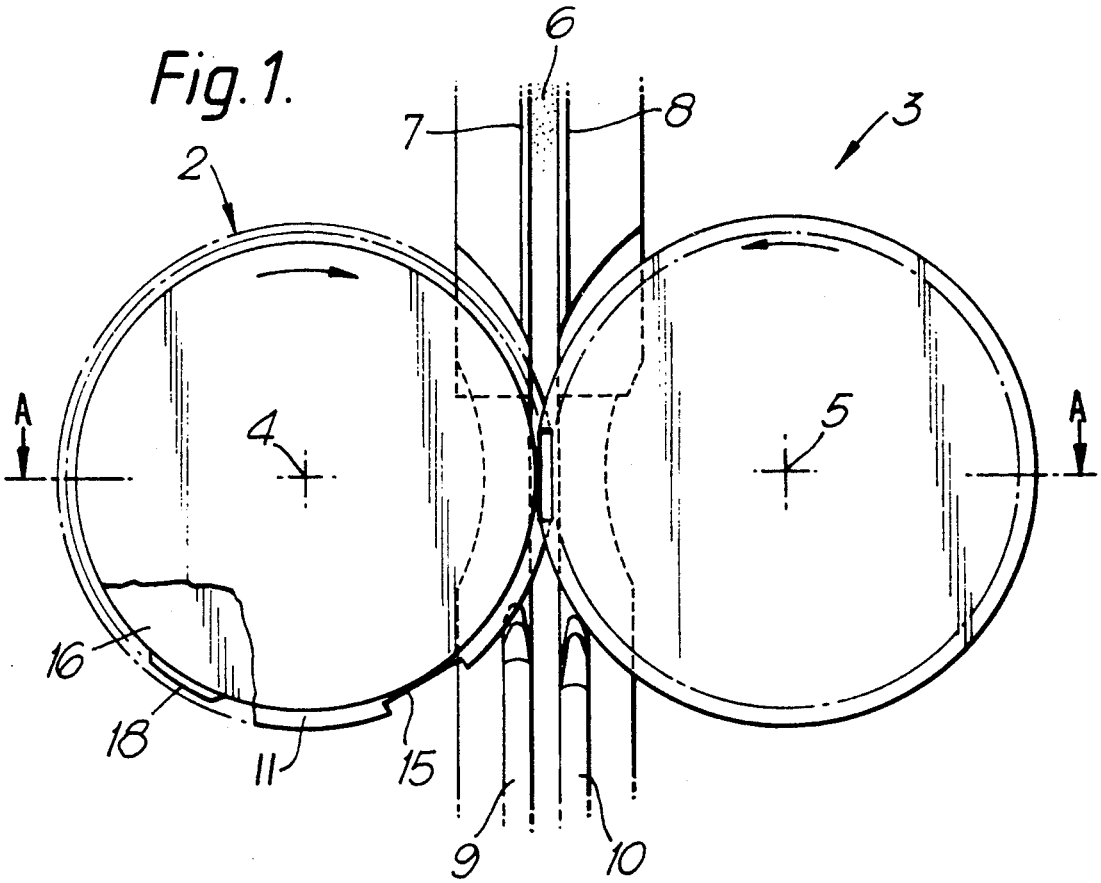
FIG. 1 is a plan view of the disc assemblies, with one assembly broken away to show the bottom disc.

FIG. 1 shows two disc assemblies 2 and 3 having laterally spaced vertical axes 4 and 5 and arranged to trim a cigarette filler stream 6 guided between rails 7 and 8 upstream of the trimming device, and between rails 9 and 10 downstream of the trimming device. The disc assemblies rotate at equal speeds in opposite directions shown by the arrows. The rails also guide and confine the sides of the filler stream in the area of the trimmer, but are cut away to allow the trimmer discs to move up and down to a limited extent to control the trimming height in response to a cigarette weight monitor (not shown).

Figure 3:
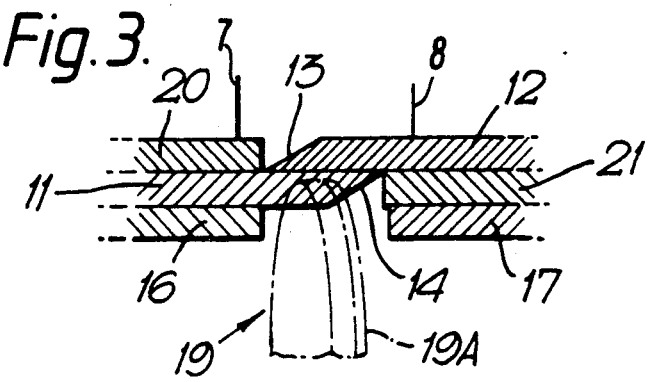
FIG. 3 is a section similar to FIG. 2 taken while the cigarette filler stream is being trimmed at its normal height.

FIG. 3 shows the main discs 11 and 12 of the two assemblies overlapping, these discs having chamfered peripheral portions 13 and 14 to form sharp edges. The discs 11 and 12 are identical, one being merely upside down with respect to the other.

Figure 2:
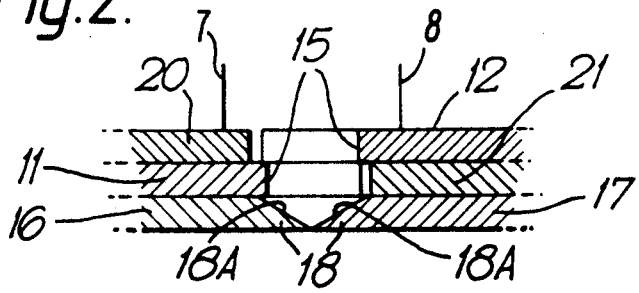
FIG. 2 is a section on the line A-A taken while the discs are in positions to form a dense end.

At regular intervals around the peripheries of the discs 11 and 12 (at 60° intervals in this example). there are cut-outs 15 which register as between the two discs so as to allow additional dense end portions of tobacco to project through the cut-outs. FIG. 2 shows a cross section on the line A-A while the cut-outs are in alignment. The "height" of the dense end portions is determined by identical discs 16 and 17 which are in the same plane and have projections 18 at positions aligned with the cut-outs 15 in the discs 11 and 12; the projections have chamfers 18A adjacent to the tobacco forming sharp edges. Elsewhere, as shown in FIG. 3, the peripheries of the discs 16 and 17 are spaced apart to allow excess tobacco below at the "normal" level defined by the overlapping trimming discs 11, 12 to drop or be removed, possibly with the aid of a rotary brush 19.

The brush 19 may comprise a machined metal disc including a flange 19A and radially extending vanes (not shown) for brushing away the surplus tobacco. The periphery of the brush is cut away along an arc of approximately 180° to clear the projections 18 while dense end portions are being formed, the brush having a speed of rotation three times that of the disc assemblies. As shown in FIG. 3, the axis of rotation of the brush is inclined to the line A-A in FIG. 1, so that the brush sweeps away excess tobacco obliquely in relation to the direction of movement of the filler stream.

The brush may be omitted, in which case the discs 16 and 17 may have a uniform cross section corresponding to that shown in FIG. 2.

The assemblies are completed respectively by two identical discs 20 and 21 equal in thickness to the discs 11 and 12 and having plain circular peripheries. Alternatively, the discs 20 and 21 may be formed as integral parts of the discs 11 and 12 respectively.

We claim:

1. A trimming device for trimming a cigarette filler stream in a cigarette making machine, comprising two cooperating disc assemblies arranged to rotate at equal speeds about laterally spaced axes and including discs from the respective assemblies which overlap to trim the filler stream at a first trim level and are formed with cut-outs in their peripheries which register during rotation of the disc assemblies so as to allow additional quantities of tobacco to project through them, to form cigarette dense end portions of the filler stream, the two disc assemblies including additional discs arranged to cooperate so as to trim away, at a set level in relation to the first trim level, excess quantities of tobacco projecting through the cut-outs.

2. A trimming device according to claim 1, in which the additional discs have projections which co-operate to remove excess tobacco projecting through the cut-outs.

3. A trimming device according to claim 1, in which the additional discs lie in the same place and have chamfered peripheral portions forming cooperating sharp edges.

4. A trimming device according to claim 1, in which the two overlapping discs are substantially identical, one being slightly below the other in an inverted position, and in which the two disc assemblies include additional plain discs, one being above the lower overlapping disc and the other being below the upper overlapping disc.

5. A trimming device according to claim 1 in which the overlapping discs have chamfered peripheral portions, the upper disc having a top chamfer and the lower disc having a bottom chamfer, so that edges formed by the chamfers lie in the plane of adjacent surfaces of the overlapping discs.

6. A trimming device according to claim 1, including a rotary brush member for laterally brushing away tobacco separated from the cigarette filler stream by the disc assemblies.

7. A trimming device for trimming a cigarette filler stream in a cigarette making machine, comprising two cooperating disc assemblies arranged to rotate at equal speeds about laterally spaced axes and including discs from the respective assemblies which overlap to trim the filler stream at a first trim level and are formed with cut-outs in their peripheries which register during rotation of the disc assemblies so as to allow additional quantities of tobacco to project through them to form cigarette dense end portions of the filler stream, the two disc assemblies including additional discs mounted for rotation in the same plane and having projections which cooperate so as to trim away, at a set level in relation to the first trim level, excess quantities of tobacco projecting through the cut-outs.

8. A trimming device according to claim 7, in which the two overlapping discs are substantially identical, one being slightly below the other in an inverted position, and in which the two disc assemblies include additional plain discs, one being above the lower overlapping disc and the other being below the upper overlapping disc.

9. A trimming device according to claim 7, including a rotary brush member adapted to brush away laterally at least some of the tobacco separated from the cigarette filler stream by the disc assemblies.

* * * * *